US005390416A

United States Patent [19]

Uchiyama et al.

[11] Patent Number: 5,390,416

[45] Date of Patent: Feb. 21, 1995

[54] ELECTRIC RAZOR

[75] Inventors: Hiromi Uchiyama; Masaki Okabe, both of Nagano, Japan

[73] Assignee: Izumi Products Company, Nagano, Japan

[21] Appl. No.: 23,057

[22] Filed: Feb. 25, 1993

[30] Foreign Application Priority Data

Apr. 17, 1992 [JP] Japan ..... 4-125693

[51] Int. Cl.[6] ..... B26B 19/14

[52] U.S. Cl. ..... 30/43.6; 30/346.51; 30/347

[58] Field of Search ..... 30/43, 43.4, 43.5, 43.6, 30/347, 346.51

[56] References Cited

U.S. PATENT DOCUMENTS

| | | | |
|---|---|---|---|
| 2,616,168 | 11/1952 | Dankers | 30/43 |
| 3,116,551 | 1/1964 | Anton | 30/43 |
| 3,119,180 | 1/1964 | Bruecker | 30/43 |
| 3,261,091 | 7/1966 | Van Den Driest | 30/43.6 |
| 4,729,169 | 3/1988 | Asawa | 30/346.51 |

FOREIGN PATENT DOCUMENTS

| | | |
|---|---|---|
| 0378266 | 7/1990 | European Pat. Off. . |
| 895433 | 1/1945 | France . |
| 1406225 | 6/1965 | France . |
| 571355 | 4/1957 | Italy . |
| 2057333 | 4/1981 | United Kingdom . |

*Primary Examiner*—Richard K. Seidel
*Assistant Examiner*—Hwei-Siu Payer
*Attorney, Agent, or Firm*—Koda and Androlia

[57] ABSTRACT

An electric razor including a plurality of external and internal cutting members in which each external cutting member has slits and a plurality of concentric tracks formed in the back and each internal cutting member has a plurality of rows of cutting edges that can rotate in the concentric tracks of the external cutting member. The slits are formed so that imaginary lines extending towards the center of the internal cutting member do not intersect the center of the internal cutting member, and the cutting edges are at the ends of the arms that extend outwardly from the internal cutting member.

5 Claims, 4 Drawing Sheets

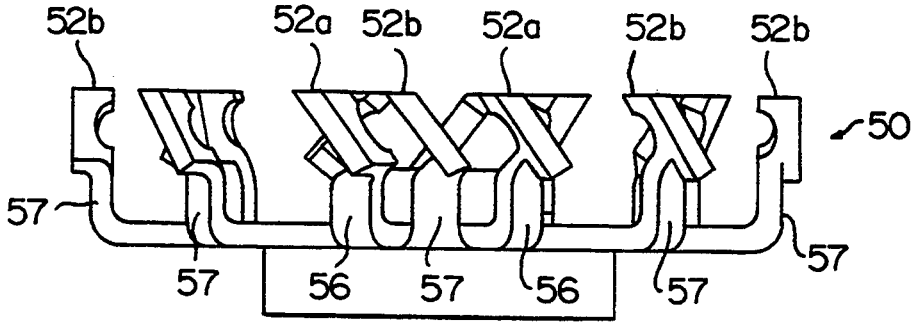
FIG. 6
FIG. 7
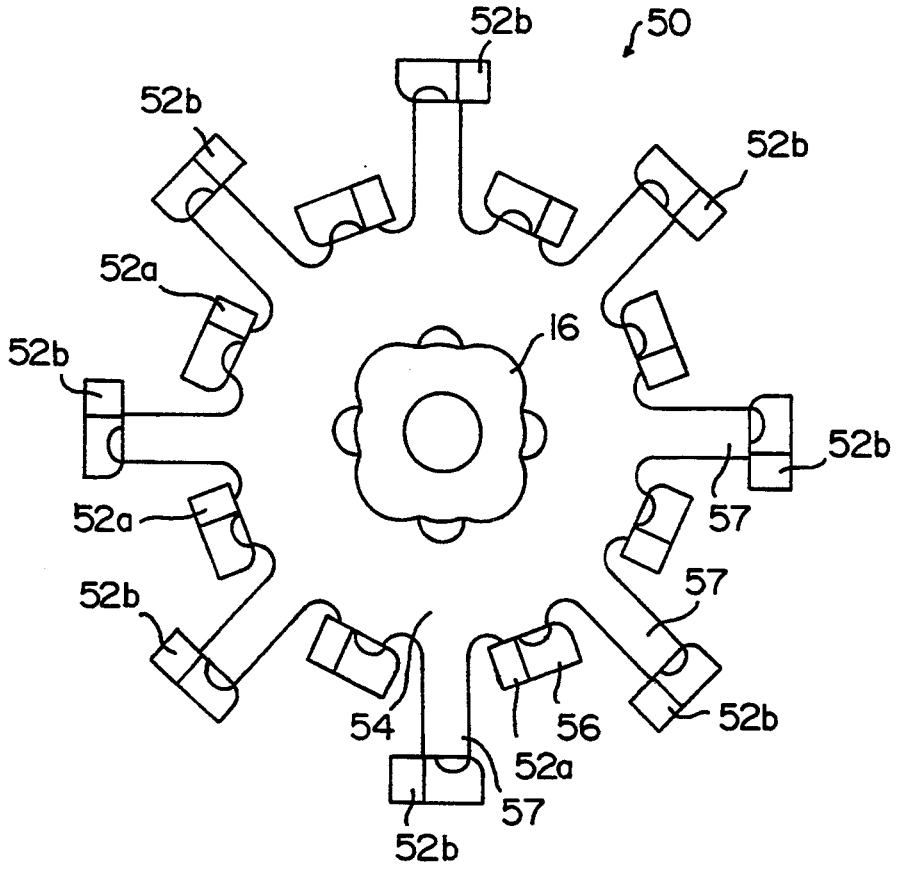

ELECTRIC RAZOR

BACKGROUND OF THE INVENTION

1. Field of the Invention

The present invention relates to an electric razor and more particularly to a multiple-track electric razor.

2. Prior Art

An electric razor that has two concentric circular shaving surfaces in an external cutting member has been known conventionally. Japanese Patent Application Publication No. 41-14339 is one example of this type of electric razor.

In this electric razor, the external cutting member that has hair-entry apertures is provided with, in its shaving surface, a circular partition groove for dividing the shaving surface into inner and outer concentric circular shaving surfaces. The back of the inner and outer shaving surfaces are defined as inner and outer tracks. The internal cutting member, on the other hand, that is used together with the external cutting member, is provided with a plurality of thin-plate-form blades mounted individually on a block formed on the internal cutting member that is rotated by a power source.

More specifically, in this prior art razor, eight angled-U-shape blades are installed in eight grooves formed in radial blocks of the base plate of the internal cutting member. Each one of the angled-U-shape blades has inner and outer cutting edges at the tip ends, and these inner and outer cutting edges are set in the inner and outer tracks of the external cutting member.

When the internal cutting member as described above is used, a plural numbers of thin-plate-form blades must be mounted on the internal cutting member. Welding, pressing, and other works are performed to obtain the internal cutting member. This, however, would cause the blades to be arranged irregularly, and grinding of the blades also takes time. Thus, many parts are required, and a substantial number of steps must be taken to assemble the cutting member and therefore the razors.

SUMMARY OF THE INVENTION

The object of the present invention is, therefore, to eliminate problems seen in the existing electric razors and to provide an electric razor that uses an internal cutting member which is obtained from a single sheet of material and has, as an integral body, cutting edges disposed in a concentric circular arrangement.

It is another object of the present invention to provide an electric razor that uses an internal cutting member which has cutting edges that are well arranged and circularly aligned together relative to their leading edges.

The objects of the present invention are accomplished by a unique structure in both the external cutting member and the internal cutting member used in electric razors. The external cutting member has radial slits for letting the hair enter into the external cutting member. These radial slits, which are arranged so that their imaginary extension lines do not intersect the center of the cutting member, are formed on the shaving surface, and the shaving surface is divided into two or more concentric circular shaving surfaces by means of one or more dividing grooves formed circularly and concentrically on the shaving surface. The back of the shaving surfaces are defined as tracks for the cutting edges of the internal cutting member, thus the external cutting member has two or more concentric circular tracks on the back. The internal cutting member, on the other hand, has arms integrally extended from the circumferential edge and bent upright, and a plurality of rows of the cutting edges are concentrically formed at the ends of the arms. These cutting edges are set in the circular tracks so that they can cut the hair when the internal cutting member is rotated.

Each one of the arms which are integral with the internal cutting member is branched into two at the tip end so that the concentric cutting edges are formed at the branched ends.

With the structure above, when the internal cutting member is rotated, the concentric cutting edges of the internal cutting member are rotated within the circular tracks of the external cutting member, thus cutting the hair which has entered through the slits into the external cutting member.

Because the internal cutting member has arms which are upright at the tip ends as an integral part of the cutting member, assembly work is not necessary for obtaining the internal cutting member.

BRIEF DESCRIPTION OF THE DRAWINGS

FIG. 6 is a front view of the internal cutting member of another embodiment according to the present invention;

FIG. 7 is a top view thereof;

DETAILED DESCRIPTION OF THE INVENTION

A first embodiment of the electric razor of the present invention will be described below with reference to FIGS. 1 through 5.

Figure 3:
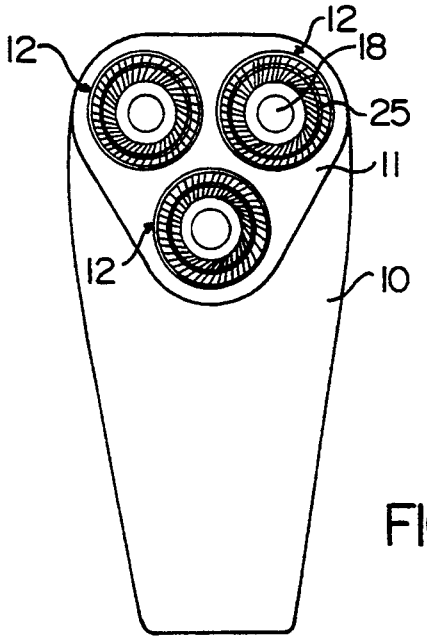
FIG. 3 is a front view of the electric razor according to the present invention.

As shown in FIG. 3, the housing 10 of the electric razor has a shaving frame 11 on the upper front portion. The shaving frame 11 is substantially in a reversed triangle shape and has a substantially flat surface. In this shaving frame 11, three external cutting members 12 are installed with equal distance in between, forming a reversed triangle.

Figure 1:
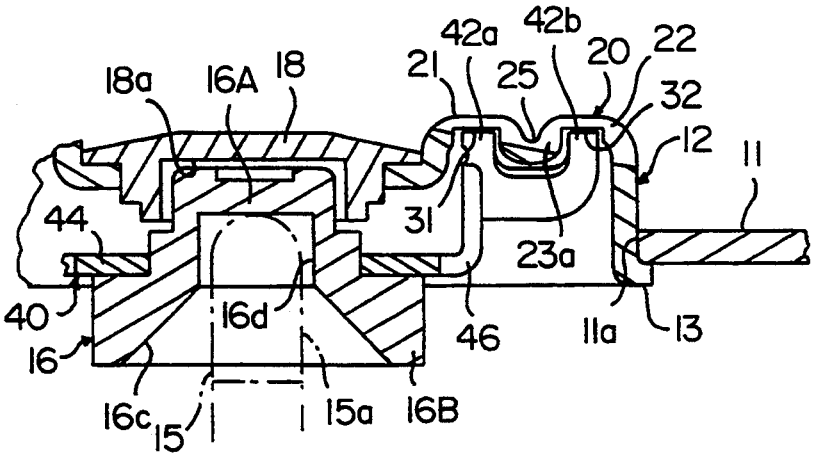
FIG. 1 shows, partially and in cross section, an internal cutting member and an external cutting member fitted together in an electric razor according to the present invention.

FIG. 1 shows one of the three external cutting members installed in the shaving frame 11.

The external cutting member 12 has a shallow cap-shape as a whole with a round top. The cylindrical periphery of the external cutting member 12 has a flange 13 at the lower edge which is bent outwardly for the entire circumference. The flange 13 is for preventing the cutting member 12 from coming off of the shaving frame 11. The external cutting member 12 has a hole at the center, and a center cover 18 is installed fixedly in this hole. The center cover 18 has a rear recess 18*a* on the back.

The external cutting members 12 thus structured are installed in the shaving frame 11 from the back by pressing them into apertures 11*a* opened in the shaving frame 11. Each external cutting member 12 in the aperture 11*a* is installed so as to be movable slightly in the axial direction (or slightly depressable) but not rotatable. With the flange 13, the external cutting member 12 does not come off of the shaving frame 11.

A more detailed description of the external cutting member will be described below.

The area around the center cover 18 of the outer surface of the external cutting member 12 is defined as a shaving surface 20 that comes into contact with skin when shaving is performed. The shaving surface 20 has two circular shaving surfaces: the inner shaving surface 21 and the outer shaving surface 22. Between these shaving surfaces 21 and 22, there is a circular groove 25 that protrudes downwardly (in the drawing). The back of the inner shaving surface 21 is an inner circular track 31, and the back of the outer shaving surface 22 is an outer circular track 32.

Figure 2:
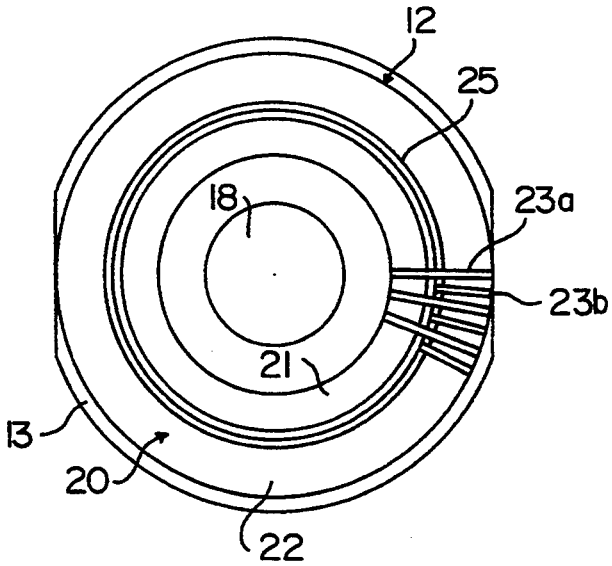
FIG. 2 is a top view of one of the external cutting members, showing some of the slits formed thereon.

The external cutting member 12 is formed with a plurality of slits that allow the hair to come into the circular tracks 31 and 32 from outside. As seen from FIGS. 1 and 2, two different types of slits are formed on the shaving surfaces: the first slits 23*a* and the second slits 23*b*. The first slits 23*a* are formed radially and across both the inner and outer circular shaving surfaces 21 and 22. The second slits 23*b*, to the contrary, are formed radially and across only the outer circular shaving surface 22. The slits 23*a* and 23*b* have a predetermined depth. FIG. 2 only shows three first and second slits 23*a* and 23*b*, though in actuality, these slits are formed alternatively for the entire shaving surface 20.

As described above, in the outer circular shaving surface 22 both the first and second slits 23*a* and 23*b* are formed alternatively for its entire surface; thus, the number of slits counted on the outer circular shaving surface 22 is twice the number of the slits formed in the inner circular shaving surface 21. Since the outer circular shaving surface 22 which is wider in the radial direction than the inner circular shaving surface 21 has twice the number of the slits the inner circular shaving surface 21 has. Accordingly, the distance between the two types of slits next to each other in the outer circular shaving surface 22 is substantially the same as the distance between the two types of slits formed in the inner circular shaving surface 21.

FIG. 3 shows a different arrangement of the slits in the shaving surface 20. In this embodiment of FIG. 3, only one type of the slits, which are the first slits 23*a* (that are longer than the second ones), are formed, and these slits 23*a* are across both the inner and outer circular shaving surfaces 21 and 22. In other words, the external cutting member 12 in FIG. 3 does not have the second slits 23*b* that are across only the outer circular shaving surface 22.

As seen from the above, the external cutting member 12 in FIG. 3 has the same number of slits on both the inner and outer circular shaving surfaces 21 and 22. Furthermore, the slits in the embodiment of FIG. 3 are formed with a predetermined angle compared to the slits formed radially as shown in FIG. 2. More specifically, the slits in the embodiment of FIG. 3 are formed at a predetermined angle (about 5°, for instance) relative to the radius of the cutting member; in other words, the imaginary lines extended inwardly from the slits do not intersect the center of the external cutting member 12. It, of course, is possible that the angled-slit-arrangement as described above is applied to an external cutting member that has both the first and second slits 23*a* and 23*b* that are formed in the inner and outer shaving surfaces 21 and 22, respectively.

A description of the internal cutting member 40 will be given below with reference to FIGS. 1, 4 and 5.

Figure 5:
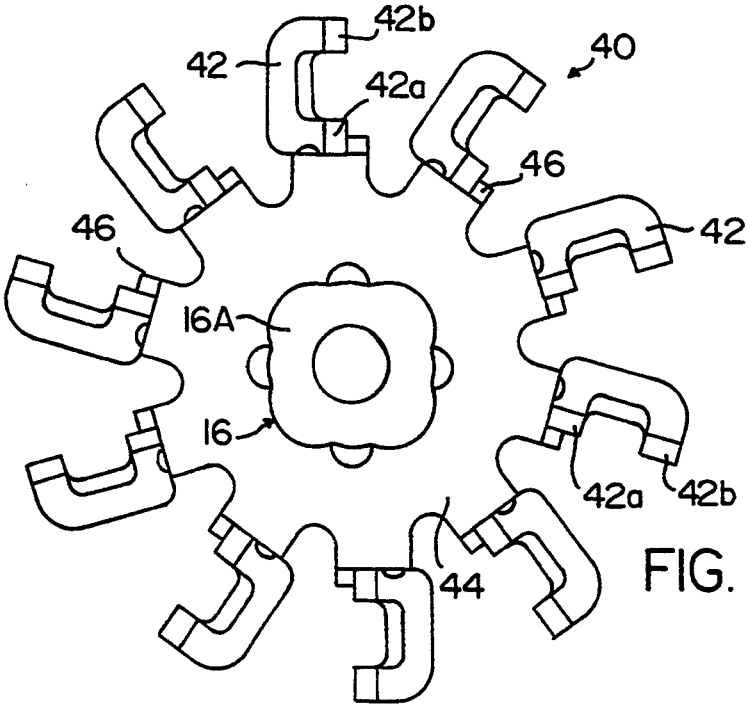
FIG. 5 is a top view thereof.

As particularly seen from FIG. 5, the internal cutting member 40 has a row of inner cutting edges 42*a* and a row of outer cutting edges 42*b* which are, as seen in FIG. 1, brought into the inner circular track 31 and the outer circular track 32, respectively.

The internal cutting member 40 has a circular base 44 at the center, and ten arms 46 extend outwardly from the circumferential edge of the circular base 44. These arms 46 are integral with the circular base 44 and equally spaced with each other in the circumferential direction. More specifically, each one of the arms 46 extends in the radial direction for some distance and is bent upright at approximately 90° (upward in FIG. 4). The upright portion of the arm 46 with a predetermined width is at a right angle relative to the radius of the circular base 44 and extends vertically (in FIG. 4), and then, from this point, the arm 46 extends, with its width gradually reducing, slantingly (in FIG. 4), which is in the direction between a counter-rotational direction (counter-clock wise in FIG. 5) and a perpendicular direction of the internal cutting member 40. In other words, the top of the upright portion of the arm is twisted. The arm 46 further extends in the direction of the radius of the circular base 44 and then has a cutter 42 which is integral with the arm 46.

The cutter 42 is branched into a U-shape so that it has at the top an inner cutting edge 42*a* and an outer cutting edge 42*b*. The cutter 42 has a flat plate shape and sets its angle, relative to the circular base 44, so that it extends slantingly in the direction between the rotational direction (clockwise in FIG. 5) and the perpendicular direction (upward in FIG. 4). In other words, the cutter 42 is slanted in the direction of rotation when viewed from the front (or sides) as shown in FIG. 4.

Figure 4:
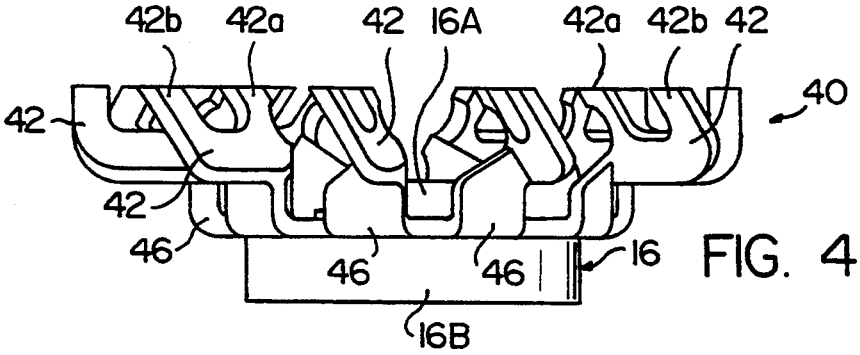
FIG. 4 is a front view of the internal cutting member used in the electric razor of the present invention.

In addition, the inner cutting edge 42*a* and the outer cutting edge 42*b* have flat top surfaces (as seen in FIG. 4). The leading edges of the inner and outer cutting edges 42*a* and 42*b* are arranged so that an inwardly extended imaginary straight line from the two leading edges of the cutting edges 42*a* and 43*b* comes across the center of the circular base 44 or the center of the internal cutting member 40 (as viewed in FIG. 5). Furthermore, all the cutting edges 42*a* and 42*b* of the internal cutting member 40 are formed so that, when the external cutting member 40 and the internal cutting member 12 are assembled together as shown in FIG. 1, the inner and outer cutting edges 42*a* and 42*b* come into close contact with the inner and outer circular tracks 31 and 32, respectively, of the external cutting member 12.

In the above description, the circular base 44, the arms 46, the cutters 42 and the inner and outer cutting edges 42*a* and 42*b* are made from a single metallic plate.

As seen in FIG. 1, into the hole at the center of the circular base 44 of the internal cutting member 40 is brought a transmission block 16 from the back (from underneath in FIG. 1) so that the intermediate diameter portion of the block 16 is securely fitted in the center hole of the circular base 44. The transmission block 16 transmits the driving force of the electric razor to the internal cutting member 40.

The transmission block 16 has a small diameter portion (the upper most portion in FIG. 1), which is at the top of the transmission block 16 and defined as a guide part 16A. The transmission block 16 also has a large diameter portion, which is at the base (or the lower most portion in FIG. 1) of the transmission block 16 and is defined as a driving force transmission part 16B. The drive force transmission part 16B has a cone-shaped entrance 16*c*; and above this entrance 16 and inside the intermediate diameter portion is a connection hole 16*d* which has a substantially rectangular cross section. Thus, when the tip end 15*a* of a drive shaft 15 is fitted in the connection hole 16*d*, the drive force from a driving source (not shown) is transmitted to and rotates the internal cutting member 40.

FIG. 1 shows the internal and external cutting members 12 and 40 as assembled. The guide part 16A of the block 16 which is secured to the internal cutting member 40 is brought into the rear recess 18*a* of the center cover 18 of the external cutting member 12. As a result, any movement of the internal cutting member 40 in the radial direction is prevented. In addition, when the internal and external cutting members 40 and 12 are assembled as in FIG. 1, the inner cutting edge 42*a* and the outer cutting edge 42*b* of the internal cutting member 40 come into close contact with the inner and outer circular tracks 31 and 32, respectively. As a result, when the internal cutting member 40 is rotated by the driving force transmitted to it, the cutting edges 42*a* and 42*b* of the internal cutting member 40 are rotated, keeping in contact with the inner and outer circular tracks 31 and 32 of the external cutting member 12, cutting the hair.

FIGS. 6 and 7 illustrates another internal cutting member 50 according to the present invention.

The internal cutting member 50 in these Figures has inner cutting edges 52*a* and outer cutting edges 52*b* which are brought into the inner circular track 31 and the outer circular track 32 of the external cutting member 12 in the same manner as the internal cutting member shown in FIG. 1.

The internal cutting member 50 comprises a circular base 54, inner arms 56 and outer arms 57. The inner arms 56 stand uprightly (or upwardly in FIG. 6) at the circumferential edge of the circular base 54. There are eight inner arms 56, and they are integral with the circular base 54 and arranged with equal intervals. Each one of the upright inner arms 56 has a predetermined width and is at a right angle relative to the radial direction of the circular base and extends perpendicularly (or upwardly in FIG. 6). The arm 56, with its width gradually reducing, extends slantingly for some distance in the direction between the counter-rotational direction (counterclockwise in FIG. 7) and the vertical direction (or upward direction in FIG. 6), and then it further extends for some distance to bend outwardly. The arm 56 thus shaped has the inner cutting edge 52*a* at the tip end. The cutting edge 52*a* has a flat top surface.

On the other hand, the outer arms 57 extend outwardly and horizontally (in FIG. 6) from the circumferential edge of the circular base 54, the outer arms 57 being longer than the inner arms 56. There are eight outer arms 57 which are integral with the circular base 54 and equally spaced with each other in the circumferential direction with the eight inner arms 56 in between. Each one of the upright inner arms 57 has a predetermined width and is at a right angle relative to the radial direction of the circular base and extends perpendicularly (or upwardly in FIG. 6). The arm 57, with its width gradually reducing, extends slantingly for some distance in the direction between the counter-rotational direction (counterclockwise in FIG. 7) and the vertical direction (or (upward direction in FIG. 6), and then it further extends for some distance to be bent outwardly. The arm 57 thus shaped has the outer cutting edge 52*b* at the tip end. The cutting edge 52*b* has a flat top surface.

As to these cutting edges of the external cutting member, an imaginary straight line drawn along the leading edge of each one of the inner cutting edges 52*a* and each one of the outer cutting edges 52*b* is at a predetermined angle relative to the diameter of the circular base 54 of the internal cutting member 50. In other words, each cutting edge has a predetermined lateral rake-angle so that when the internal and external cutting members 50 and 12 are assembled as shown in FIG. 1, all the inner cutting edges 52*a* and outer cutting edges 52*b* of the internal cutting member 50 come in close contact with the inner and outer circular tracks 31 and 32, respectively.

The circular base 54, the inner arms 56, the outer arms 57, the outer cutting edges 52*a*, and the inner cutting edges 52*b* are made from a single metallic plate. The rest of the structure of the internal cutting member 50 is the same as the one shown in FIGS. 3 and 4.

When the internal cutting member 40 shown in FIGS. 4 and 5 and the internal cutting member 50 shown in FIGS. 6 and 7 are compared, the internal cutting member 40 has ten inner cutting edges 42*a* and ten outer cutting edges 42*b* which are obtained from a single material; to the contrary, only eight inner cutting edges 42*a* and eight outer cutting edges 42*b* are formed in the internal cutting member 50. Thus, the internal cutting member 40 has 10/8 times more cutting edges than the internal cutting member 50. As a result, when the internal cutting member 40 is used, the drive shaft 15 can rotate at a speed of 8/10 of the speed of the cutting member 50. When the drive shaft 15 is rotated thus slower via the use of the cutting member 40, vibrations and noises can be less than the inner cutting member 50 which is rotated faster.

A description of the method for making the external cutting member 12 will be presented.

The slits of the shaving surface 20 of the external cutting member 12 are formed on the shaving surfaces 21 and 22 by use of a rotary cutter 70.

Figure 8:
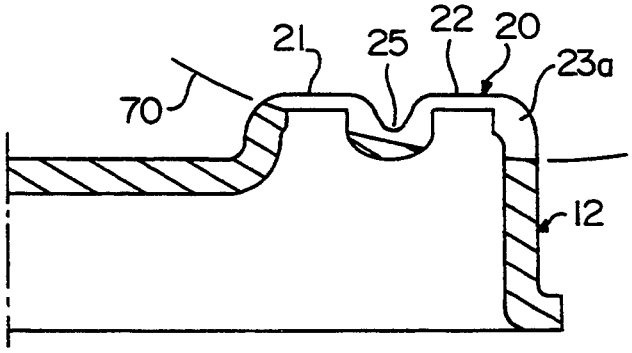
FIG. 8 illustrates how the slits are made in two shaving surfaces of the external cutting member.
Figure 9:
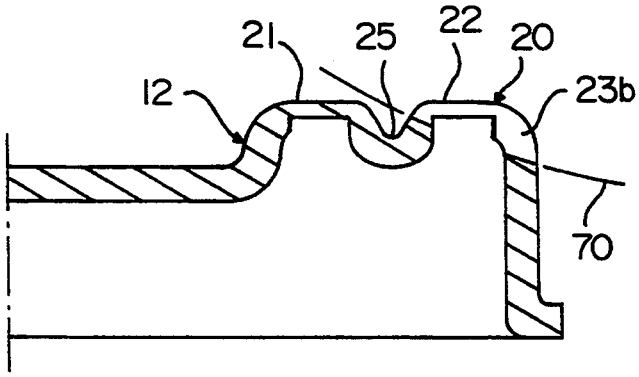
FIG. 9 illustrates how the slits are made in a shaving surface of the external cutting member.

For opening the first slits 23*a* into the shaving surfaces 21 and 22, the rotary cutter 70 is positioned to come into contact with the shaving surfaces 21 and 22 and then moved toward the back of the external cutting member 12 (see FIG. 8). For opening the slits 23*b* in the outer side shaving surface 22, the rotary cutter 70 is moved to a position where it comes into contact with only the outer circular shaving surface 22. Then, the rotary cutter 70 is moved toward the back of the external blade 12 while being kept in contact with the outer shaving surface 22 (see FIG. 9).

In either case, after making one slit, the external cutting member is rotated by a predetermined distance, and the slit forming is repeated for the entire surfaces. The slits 23*a* and 23*b* are the deepest at the outer circumference of the outer circular shaving surface 22.

In the embodiments described above, the shaving surface 20 is divided into two concentric circular surfaces to form the two concentric circular tracks 31 and 32 (or in a "dual-track" formation), and the inner and outer cutting edges are rotated inside the two circular tracks, respectively. However, the shaving surface and therefore the tracks of the external cutting member may be formed in triple, quadruple, or quintuple in number. If these plural (more than two) shaving surfaces and plural (more than two) tracks are employed, then the internal cutting member is provided with a plurality of rows of concentric cutting edges that correspond to the number of the circular tracks.

The internal cutting members described above may be obtained by cutting, pressing, bending, etc. strips of steel or other suitable metal of a prior art technique.

In addition, each of the internal cutting members of the present invention is formed so that a plurality of integral arms extend from the circumferential edge of the circular base of the cutting member, and the cutting edges are at the ends of the arms concentrically. Thus, the internal cutting members are obtained from a single sheet of material by cutting and bending. Accordingly, the internal cutting members obtained according to the present invention can have cutting edges that are regularly and uniformly arranged (in height, direction, length, etc.) compared to the prior art cutting members that are made out of several parts that are welded, pressed, etc.

Furthermore, the number of parts that make the internal cutting member of the present invention is less than those of the prior art cutting members; as a result, the steps needed to obtain the cutting member are less, and the time required to obtain the cutting member is short, and the cost of manufacturing is low.

Furthermore, the cutting member shown in FIGS. 4 and 5 can have more cutting edges than the cutting member in FIGS. 7 and 8; accordingly, the rotating speed for the cutting member of FIGS. 4 and 5 can be low with less vibrations and noises.

We claim:

1. An electric razor comprising:

an external cutting member having a circular shaving top surface, said top surface being provided with a plurality of radial slits for hair entry and divided into at least two concentric shaving surfaces by at least one concentric groove; and an internal cutting member comprising:

a circular base rotated by a rotary power source;

a plurality of arms equally spaced around a periphery of said circular base, said arms extending upwardly and outwardly from said circular base and terminated at a distal end;

a cutter provided on each of said plurality of arms, said cutter being formed in a U-shape with a bottom of said U-shape being connected at said distal end; and a cutting edge formed on each of two upwardly extending arms of said U-shape cutter; and wherein:

said circular base, plurality of arms and cutters are integrally formed;

said plurality of arms are provided at a constant radius from a center of said circular base; and said cutting edges formed on said two upwardly extending arms U-shape of said cutter engage respectively with said two concentric shaving surfaces.

2. An electric razor according to claim 1, wherein said slits are formed so as to cross said two concentric shaving surfaces with an imaginary line inwardly extending from each one of said slits not intersecting a center of said external cutting member.

3. An electric razor according to claim 1, wherein said electric razor is provided with three pairs of said internal and external cutting members.

4. An electric razor according to claim 3, wherein said three pairs of internal and external cutting members are arranged in a triangular configuration.

5. An electric razor according to claim 3, wherein substantially half of said radial slits only extend through an outer of said two concentric shaving surfaces.

* * * * *

UNITED STATES PATENT AND TRADEMARK OFFICE

CERTIFICATE OF CORRECTION

PATENT NO. : 5,390,416

DATED : February 21, 1995

INVENTOR(S) : Hiromi Uchiyama, et al.

It is certified that error appears in the above-indentified patent and that said Letters Patent is hereby corrected as shown below:

In Column 8, Line 24: Add the phrase --of said-- between "arms" and "U-shape"; and delete the phrase --of said-- between "U-shape" and "cutter."

Signed and Sealed this

Sixteenth Day of March, 1999

*Attest:*

*Attesting Officer*

Q. TODD DICKINSON

*Acting Commissioner of Patents and Trademarks*